US005466012A

United States Patent [19]

Puckett et al.

[11] Patent Number: 5,466,012

[45] Date of Patent: Nov. 14, 1995

[54] FACSIMILE SECURITY SYSTEM

[75] Inventors: Richard D. Puckett, Miamisburg; Thomas J. Obringer, Vandalia; Thomas C. Miller, Kettering, all of Ohio

[73] Assignee: NCR Corporation, Dayton, Ohio

[21] Appl. No.: 229,858

[22] Filed: Apr. 19, 1994

Related U.S. Application Data

[63] Continuation of Ser. No. 983,349, Jan. 7, 1993, abandoned.

[51] Int. Cl.[6] ..... B42D 15/00

[52] U.S. Cl. ..... 283/67; 283/73; 283/17

[58] Field of Search ..... 283/17, 67, 73, 283/901, 902; 380/54

[56] References Cited

U.S. PATENT DOCUMENTS

| | | | |
|---|---|---|---|
| 4,853,256 | 8/1989 | Obringer et al. | 427/152 |
| 4,896,355 | 1/1990 | Iggulden et al. | 283/73 X |
| 4,941,685 | 7/1990 | Anderson | 282/1 R |
| 5,029,901 | 7/1991 | Dotson et al. | 462/8 R |
| 5,085,469 | 2/1992 | Castro | 283/901 X |
| 5,178,420 | 1/1993 | Shelby | 293/94 |
| 5,184,849 | 2/1993 | Taylor | 283/117 |

*Primary Examiner*—Willmon Fridie
*Attorney, Agent, or Firm*—Craig E. Miller

[57] ABSTRACT

A facsimile security system includes a base sheet capable of having confidential information thereon and a cover sheet with imprinting thereon for obscuring the confidential information on the base sheet. The imprinting comprises lines in a repeated pattern over the cover sheet and the lines are separated by spaces without imprinting which spaces extend across the cover sheet or in an elongated direction of the cover sheet. The spaces may extend in a diagonal direction on the cover sheet or the spaces may extend only partially across the cover sheet in a repeated pattern. The cover sheet is preprinted in a preferred form of the invention.

16 Claims, 7 Drawing Sheets

FACSIMILE SECURITY SYSTEM

This is a continuation of application Ser. No. 07/983,349 filed on Jan. 7, 1993, now abandoned.

BACKGROUND OF THE INVENTION

In the field of communication transmission, the facsimile machine is being used by a greater number of companies and individuals for rapid delivery of data. It is well-known, of course, that any hard copy of data, or like information, can be transmitted by the facsimile method and received in a very short period of time. Examples of material that are commonly transmitted by facsimile are letters, documents, forms, maps, instructions, memorandums and like media.

It is also known that the material or information on the facsimile media that is being transmitted is subject to being viewed and/or read by someone other than the intended party at the receiving end of the operation. In the case of confidential information, it is desired that some means of obscuring or hiding the information from unwanted eyes be a part of the overall operation.

U.S. Pat. No. 4,941,685, issued to M. W. Anderson on Jul. 17, 1990, discloses a multiple part facsimile form with a first form part having prerecorded information thereon and overlying a second form part.

U.S. Pat. No. 5,029,901, issued to M. Dotson et al. on Jul. 9, 1991, discloses a confidential information bearing article having a cover sheet adhered to a base sheet which provides hidden confidential information to a recipient. The use of camouflage, obscuring, and opacifying and reflectivity increasing coating effects an opaque paper media.

SUMMARY OF THE INVENTION

The present invention relates to a facsimile transmission operation and, more particularly, to a facsimile security system. In one embodiment of the invention, a thin, coated paper of an opaque nature is placed over a thermally active paper to provide obscuring of information on the thermal paper. The opaque paper provides security of the message below, however the opaque paper needs to be removed in order to ascertain the identity of the recipient. In another embodiment of the invention, the thin paper is opaque only in certain areas and is translucent in other areas to enable the recipient to be identified without removing the entire top sheet of paper.

The overall facsimile media is similar to two ply thermal paper and the thermal coating causes the upper or top layer of tissue to adhere to the lower or base sheet with a degree of adherence that permits the top layer to be easily removed from the base sheet.

In accordance with the present invention, there is provided a security system for a facsimile document comprising a base sheet capable of having confidential information thereon for sending by a facsimile process, and a cover sheet on said base sheet, said cover sheet having a plurality of sections with imprinted lines forming an obscuring pattern over the confidential information and said imprinted lines being separated by portions of said cover sheet without imprinted lines.

In view of the above discussion, a principal object of the present invention is to provide security for a transmitted message.

Another object of the present invention is to provide a two ply facsimile media that obscures at least portions of the transmitted message.

An additional object of the present invention is to provide a facsimile security system having a coated media that is easily removable from the media containing the transmitted message.

A further object of the present invention is to provide a preprinted format for a facsimile system wherein the body of the paper is protected from observation and is maintained in confidence and the header or footer of the paper is not protected to permit one to identify the receiving party.

Still another object of the present invention is to provide a method of obscuring confidential information on a document transmitted by a facsimile process.

Additional advantages and features of the present invention will become apparent and fully understood from a reading of the following description taken together with the annexed drawing.

DESCRIPTION OF THE PREFERRED EMBODIMENTS

Figure 1:
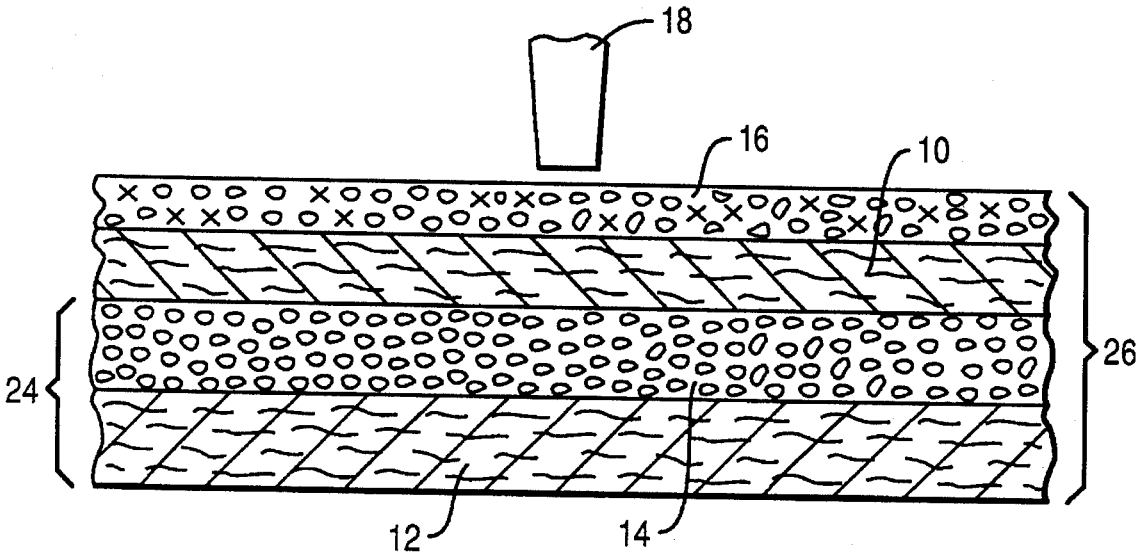
FIG. 1 is a diagrammatic view of the media incorporating the subject matter of the present invention.

FIG. 1 illustrates in diagrammatic form a media of the present invention wherein a front or top tissue-type sheet 10 is collated with a back or bottom bond-type sheet 12. A thermoreactive coating 14 is provided on the sheet 12 and is sandwiched between the two sheets and the imaging technique is accomplished during heating of a thermoreactive coating 16 on the front surface of the sheet 10 and heating of the coating 14 on the front surface of the bond sheet 12.

The present invention provides for applying and using the thermoreactive coating 14 on the bond sheet 12 as an adhering agent for laminating the sheet 10 to the sheet 12.

EXAMPLE I

Example I describes the materials for use with the method wherein the coating 14 of thermochromic material is applied to the front side of the bond sheet 12 and such sheet is mated or collated with the tissue sheet 10 so that the coating material 14 is sandwiched between the back surface of the tissue sheet 10 and the front surface of the bond sheet 12, as illustrated in FIG. 1. The two sheets are then imaged by use of heat from a plurality of thermal elements, such as 18, wherein the coating 14 and the coating 16 provide for a two ply record medium consisting of the sheets 10 and 12.

Coating Composition

The thermoreactive coating formulation 14 for the base sheet 12 essentially consists of a thermochromic dye, a phenolic resin, one or more waxes and a binder. A preferred coating composition utilizing black dye for black print is as follows:

| Base Coat | | |
|---|---|---|
| Material | Percent Dry Weight | Range |
| Dye (Black) | 10.0% | 8–12% |
| PVA | 10.6 | 9–13 |
| Nopco NDW | 0.5 | 0–1 |
| Niaproof 08 | 0.5 | 0–1 |
| Bisphenol | 42.7 | 37–48 |
| P-Benzyl Biphenyl | 17.6 | 14–21 |
| Armoslip 18 | 8.8 | 7–10 |
| Ansilex Clay | 8.8 | 7–10 |
| Tinopal PT | 0.4 | 0–1 |

The coating 16 is coated onto sheet 10 prior to lamination of the coating 14 on sheet 12 for forming thermal type media 24. This coating 16 provides the image for the top sheet.

| Top Coat | | |
|---|---|---|
| Material | Percent Dry Weight | Range |
| Dye (Black) | 5.9% | 5–7% |
| Dye (Blue) | 0.1 | 0–0.2 |
| PVA | 15.0 | 10–20 |
| Nopco NDW | 0.5 | 0–1 |
| Niaproof 08 | 0.4 | 0–1 |
| Calgon | 0.4 | 0–1 |
| Bisphenol | 22.2 | 18–25 |
| Acrawax C | 12.0 | 10–15 |
| Armid HT | 5.0 | 4–6 |
| Ansilex Clay | 33.9 | 28–40 |
| Titanium Dioxide | 2.6 | 1–4 |
| Zinc Stearate | 2.0 | 1–3 |

Figure 2:
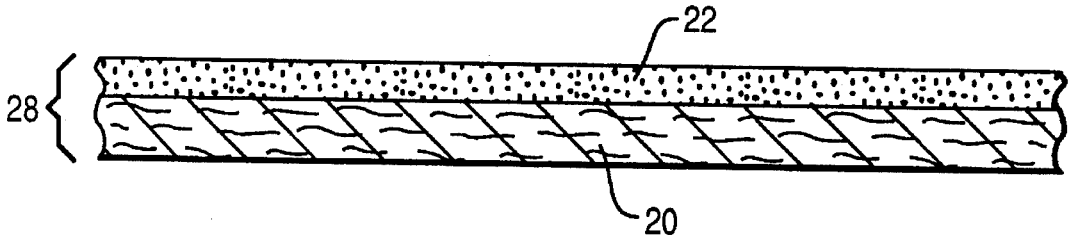
FIG. 2 is a diagrammatic view of a heat reactive coating applied to a base sheet and utilized in the practice of the present invention.

FIG. 2 shows a base sheet 20 coated with a heat reactive coating 22 to form a thermal type media 28 for use with the thermal elements 18.

Figure 3:
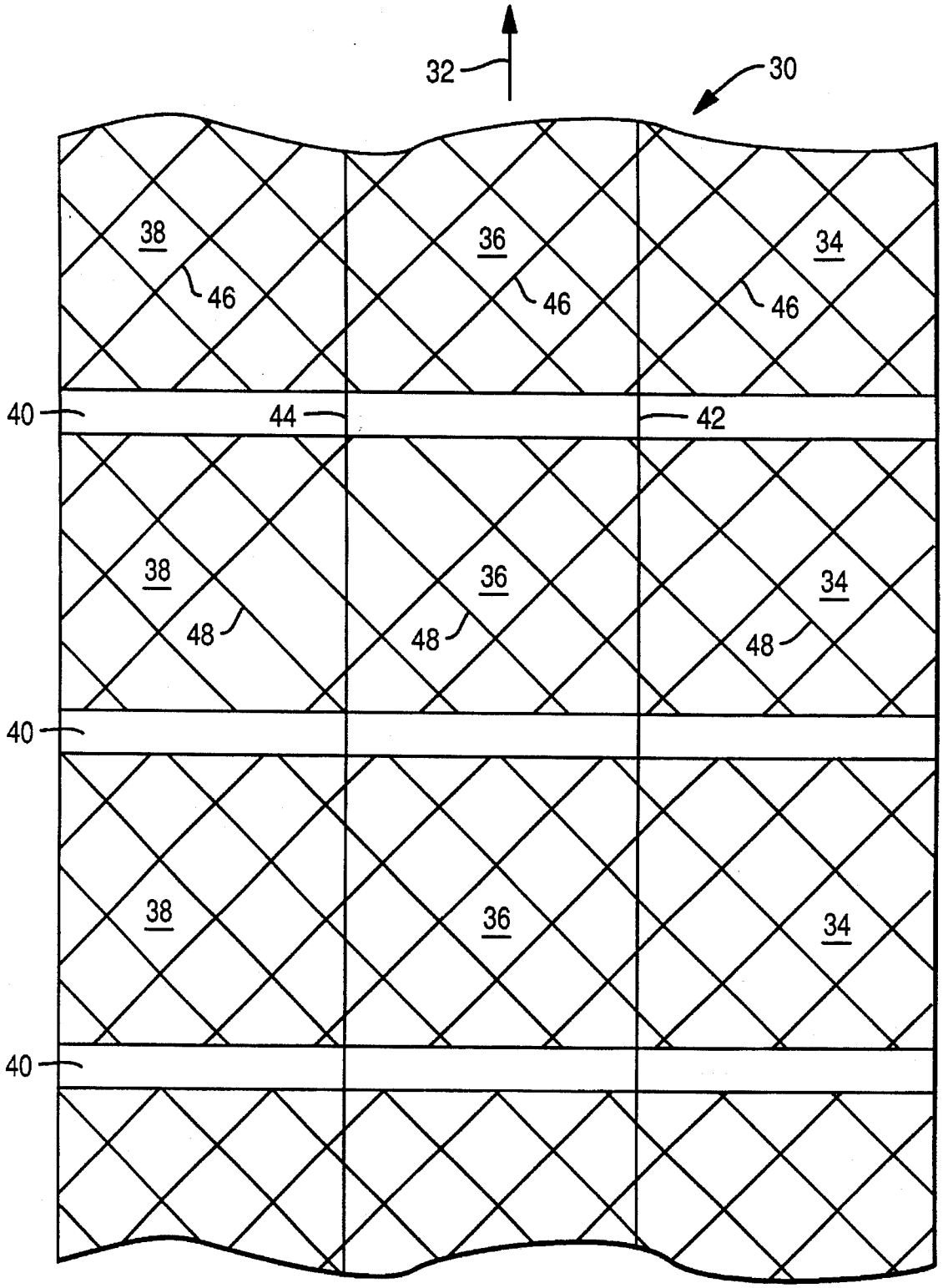
FIG. 3 is a plan view of a web of paper having a pattern thereon for obscuring a printed or like message.

FIG. 3 is a view of a portion of a web 30 of tissue paper which web may be moving in the direction of the arrow 32. The web 30 is divided into sections, as 34, 36 and 38 which constitute a repeated pattern of printed material and which sections are separated by cross-web portions 40 in a preferred arrangement of the web. The cross-web portions 40 are unprinted and are positioned in any given repeated location along the web 30. The lines 42 and 44 would not necessarily be printed but would be the edges of the portions 40. The cross hatch lines 46 directed from southwest to northeast and the cross hatch lines 48 directed from southeast to northwest are printed lines and may be any of the confidential type markings used in the printing industry. The lines 46 and 48 may be of different type or shape such as wavy lines, lines of dots or lines of dashes or the like. Additionally, the cross hatched areas may represent a solid fill construction or such areas may be patterns of different shades of solid fill. If a solid fill is used, the shades should have a Technidyne BNL opacity of less than 15.0.

Figure 4:
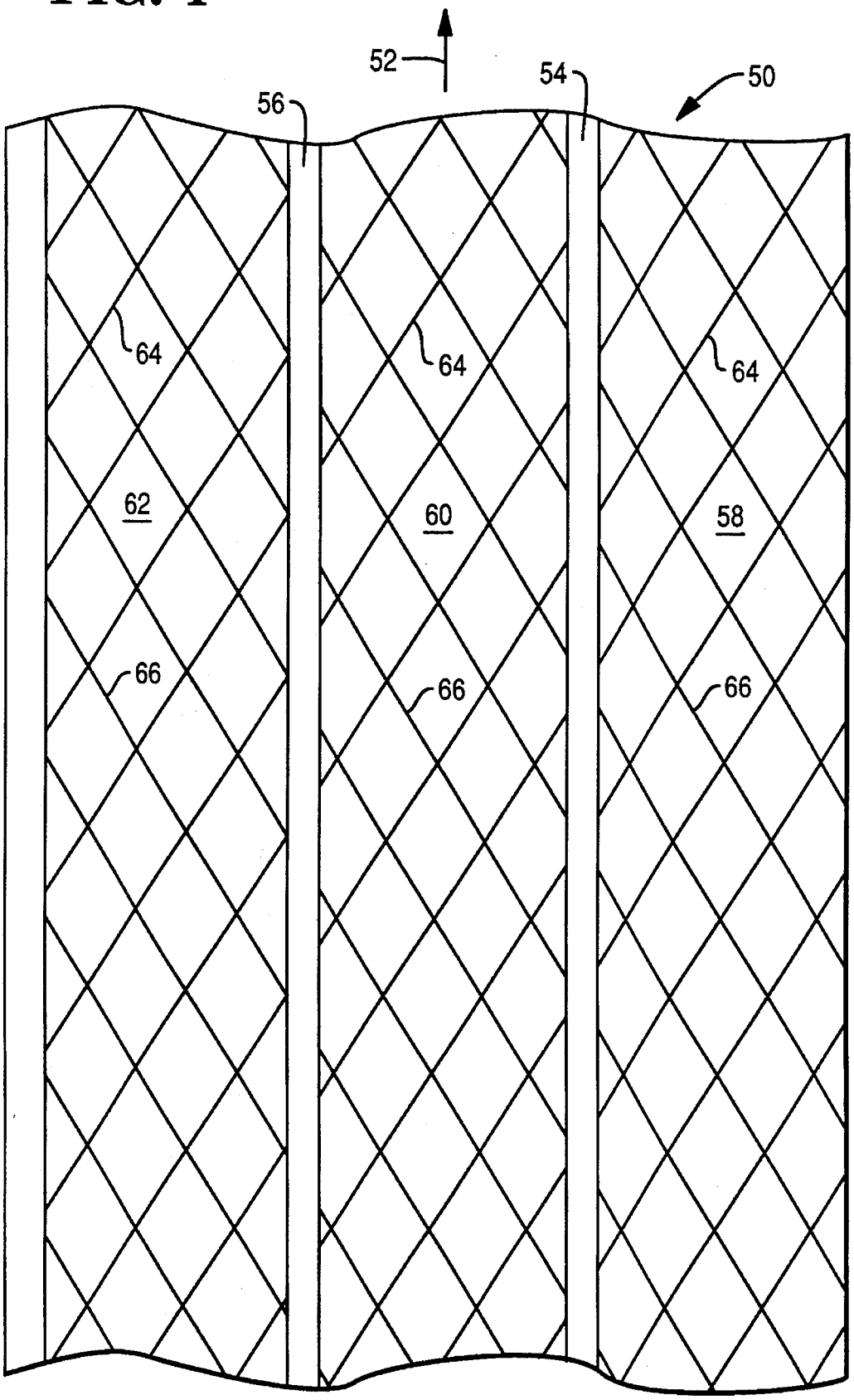
FIG. 4 is a plan view of a web of paper having a modified pattern thereon.

FIG. 4 is a view of a modified arrangement of a portion of a web 50 of tissue paper which web may be moving in the direction of the arrow 52, and wherein the unprinted portions 54 and 56 are positioned in the elongated direction of the web. The web 50 is divided into sections 58, 60 and 62 separated by portions 54 and 56. The cross hatch lines 64 and 66 are printed lines of the type and shape as described above.

Figure 5:
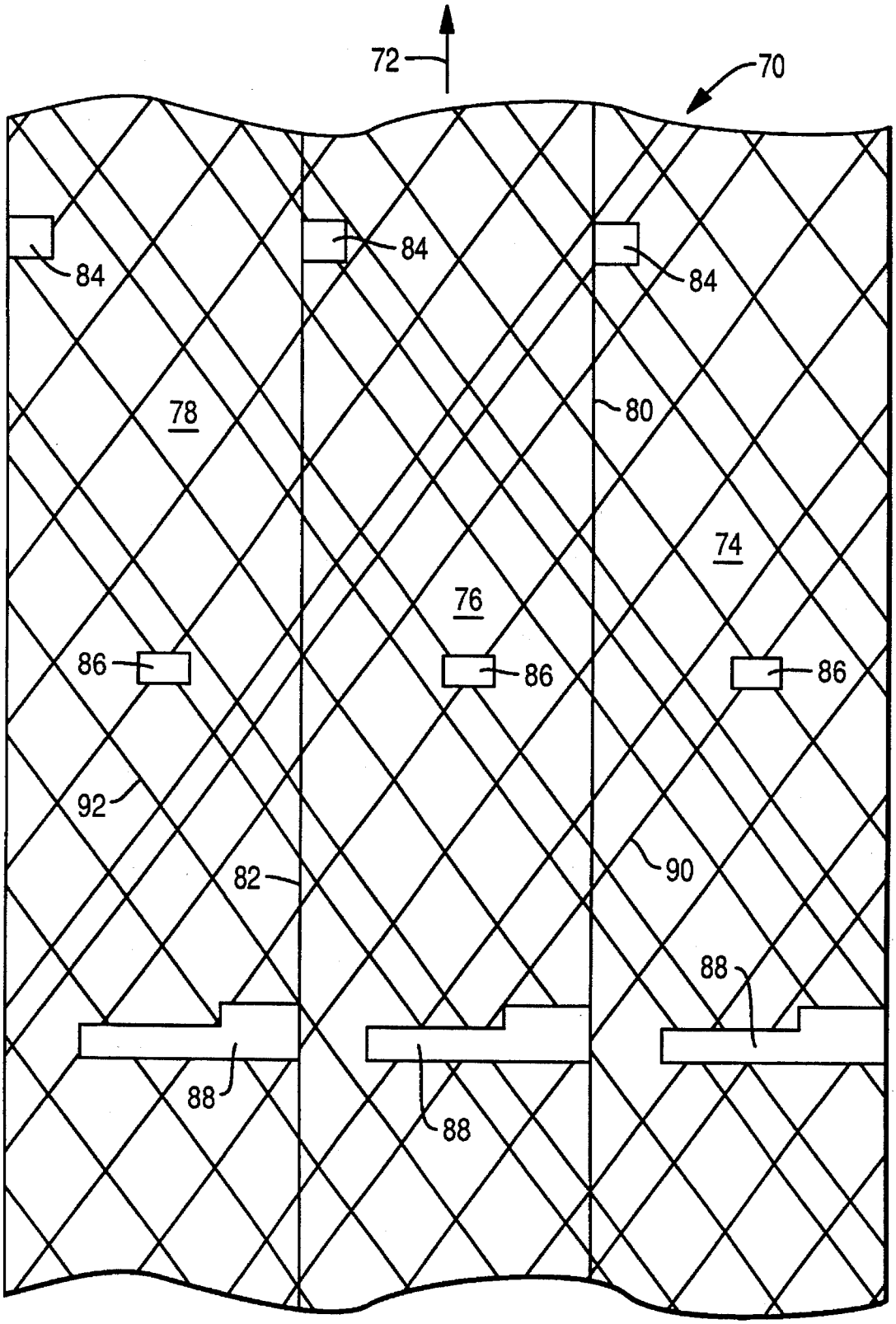
FIG. 5 is a plan view of a web of paper having a further modified pattern thereon.

FIG. 5 is an illustration of a further modified arrangement of a web 70 moving in the direction of the arrow 72. The web 70 is divided into sections 74, 76 and 78 separated by lines 80 and 82. Each of the sections 74, 76 and 78 includes a plurality of unprinted portions 84, 86 and 88. The unprinted portions 84, 86 and 88 may be of any desired size and shape and extend across a portion of the sections 74, 76 and 78. The cross hatch lines 90 and 92 are printed lines of the type and shape as described above.

Figure 6:
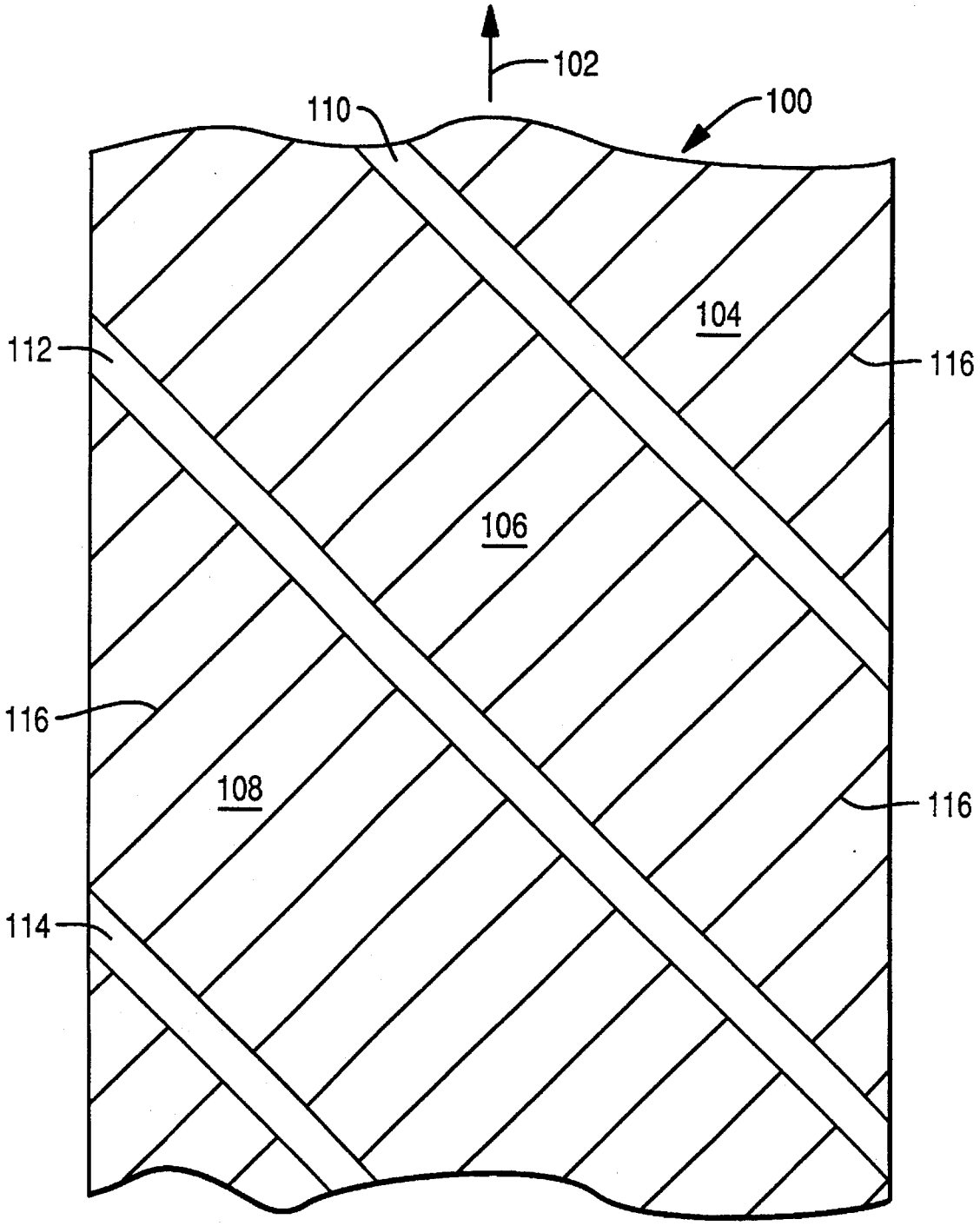
FIG. 6 is a plan view of a web of paper having a still further modified pattern thereon.

FIG. 6 is a view of a still further modified arrangement of a web 100 moving in the direction of the arrow 102. The web 100 is divided into sections 104, 106 and 108 separated by unprinted portions 110, 112 and 114 spaced so as to effect repeating patterns along the web. The unprinted portions 110, 112, and 114 are perpendicular to the diagonal lines 116 which are printed on the web 100.

Figure 7:
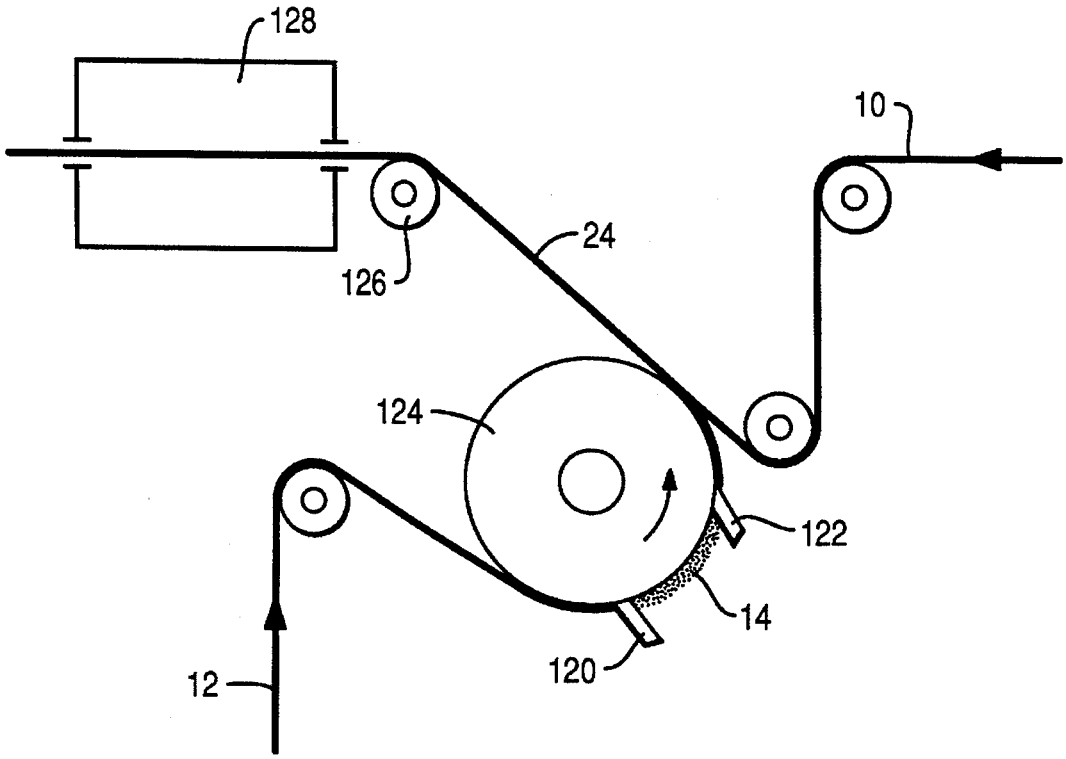
FIG. 7 is a diagrammatic view of a method of preparing the facsimile media in the practice of the present invention.

FIG. 7 illustrates a preferred method by which the preprinted top sheet 10 is laminated with the base sheet 12 with the wet coating 14 therebetween. The top sheet 10 is collated with the base sheet 12 in a single operation, immediately following (0.1 to 0.5 seconds) application of the coating 14 by an applicator 120, and spreading of the coating 14 evenly by suitable means such as a doctor blade 122. The two sheets 10 and 12 may then be rolled by means of a roller 124 to eliminate wrinkles and secure alignment of the two sheets together in a laminated manner. The wet or like thermally reactive coating 14 serves as an adhesive to laminate the two sheets 10 and 12 which in such condition are trained over a roller 126 and dried in a dryer 128.

The thermally reactive coating 14 is applied to the base sheet 12, and the overlay sheet 10 is applied to the base sheet 12 by the arrangement of FIG. 7, wherein the laminate is then dried and also may be calendered. The coating 14 is in the range of three to five pounds dry weight per ream on paper 12.

Calendering enhances the bond of the overlay sheet 10 to the support sheet 12 and increases the quality of the developed image. The process of coating by means of the applicator 120, as shown in FIG. 7, may include blade coater application, kiss roll, extrusion application, gravure, or air knife application.

Figure 8:
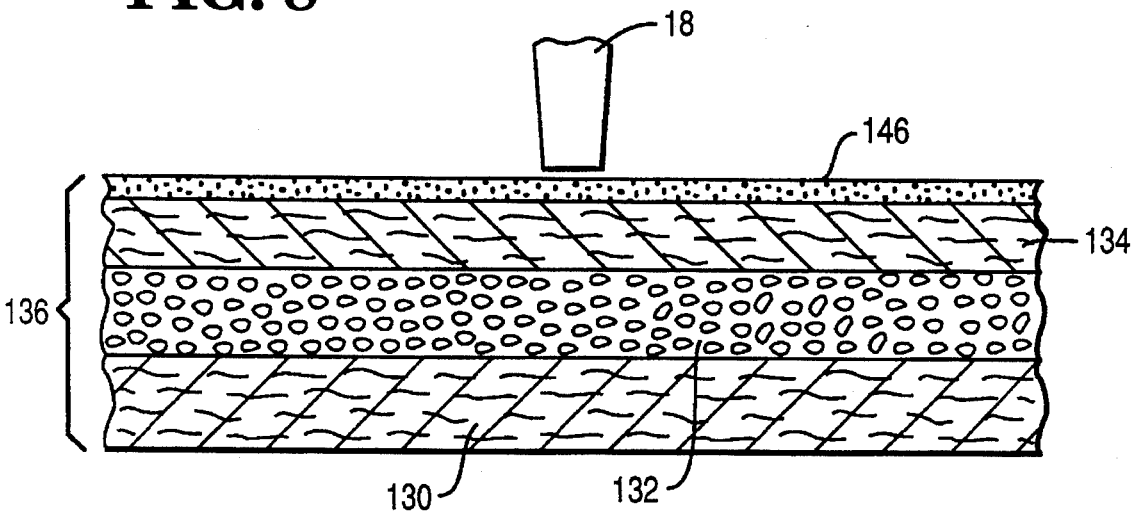
FIG. 8 is a diagrammatic view of the media incorporating preprinted images in the practice of the invention.

FIG. 8 illustrates a cross-sectional view of a thermally reactive media of the present invention in a preferred embodiment thereof wherein a back or bottom bond-type sheet 130 has a thermoreactive coating 132 thereon and such sheet 130 is collated with a front or top sheet 134 having a thermally reactive coating 146. Imaging technique is accomplished during heating of thermally reactive coating 146 to a relatively high temperature in the range of 130° F. to 175° F. thus forming an opaque sheet for the facsimile media or paper 136.

Figure 9:
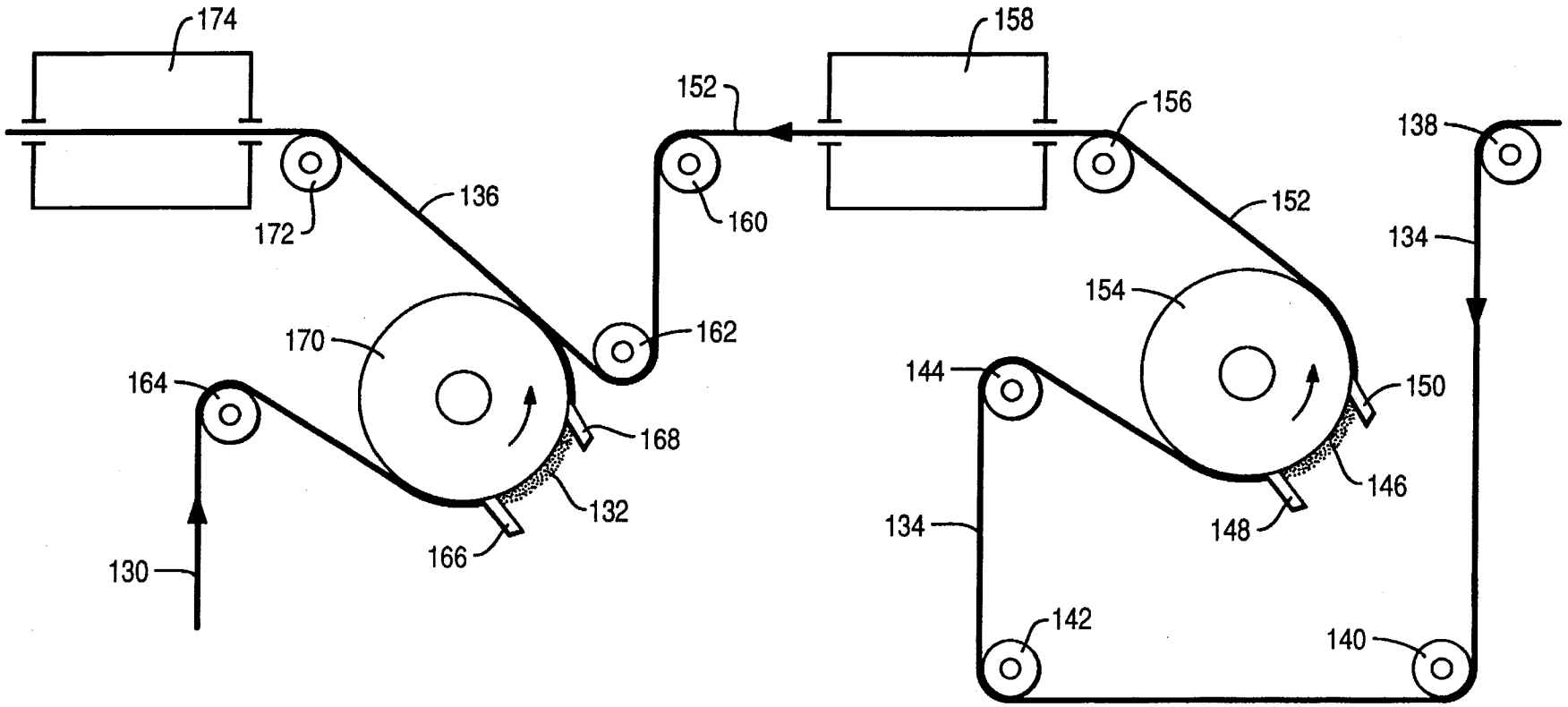
FIG. 9 is a diagrammatic view of an alternative method of preparing the facsimile media.

FIG. 9 illustrates a preferred method of fabricating the security-type facsimile media shown in FIG. 8 wherein the tissue-type sheet 134 is subjected to the above-noted relatively high temperature in a dryer 158 prior to lamination thereof to the base sheet or bond-type paper 130. The sheet 134 is trained in a path around rollers 138, 140, 142 and 144 and thermally reactive coating 146 is applied on the sheet 134 by a printing applicator 148 and is smoothed by a blade 150. The coated sheet 152 is pressed or rolled smooth by a roller 154 and is then trained around a roller 156 prior to entering the dryer 158. The high heating temperature forms an opaque sheet 152 which is utilized to obscure the information on the facsimile media 136. In this respect the process utilizes a preactivated thermal coating material 146 to provide the opaque sheet 152. The temperature of 130° F. to 175° F. applied to the opaque sheet 152 is dependent upon the dwell time in passing through the dryer 158. Assuming a web speed of 1000 feet per minute and a dryer 158 that is 40 feet in length, the dwell time for accomplishing the opaque sheet 152 is calculated to be 2.4 seconds.

The opaque sheet 152, after passing through the dryer 158, is trained around rollers 160 and 162 and is then collated with the base sheet 130. The base sheet 130 is trained around a roller 164 and an applicator 166 applies the thermoreactive coating 132 which is spread evenly by a blade 168 as the base sheet 130 is traveling around a roller 170. The facsimile media 136 is then dried in a dryer 174. A lower heat of approximately 115° F. is used in the dryer 174 for the base sheet or the bond-type paper 130.

The various ingredients utilized in the thermally reactive coating of the present invention are further identified and are available from the noted sources. The polyvinyl alcohol (PVA) is available from Air Products Corporation, and the bisphenol (4,4-isopropylidenediphenol), as a reactive material of the phenol group, is available from Dow Chemical Company. The blue color forming dye is of the leuco group and is available from Hilton-Davis Company and the black color forming dye or the fluoran group is Pergascript from Ciba-Geigy Corporation or S205 from Yamada Chemical Company. The Behenyl Alcohol is a saturated fatty alcohol used as a temperature modifier and is available from Fallack Chemical Company, the Acrawax C is a synthetic wax and is available from Glyco Inc., and the amide wax is Armid HT or Armoslip 18 from Armour Chemical Company.

The filler may be calcium carbonate supplied by Georgia Marble Company or the filler may be Ansilex clay supplied by Englehard Corporation. Nopco NDW is a defoamer of the glycol group and is available from Diamond Shamrock Corporation, Niaproof 08 is a sodium 2-ethylehexyl sulfate used as a wetting agent and is available from Niacet Corporation, and Calgon is sodium hexametaphosphate available from Calgon Corporation. Tinopal PT is a fluorescent brightener available from Ciba-Geigy Corporation. The P-Benzyl Biphenyl is a hydroxy cyclic compound used as a temperature modifier in a lower range than the Behenyl Alcohol and is available from Nagase America Corporation. The titanium dioxide is a white pigment available from N. L. Industries (National Lead Corporation), and the zinc stearate is used as an anti-stick agent and is available from Witco Chemical Company.

It is thus seen that herein shown and described is a facsimile security system wherein a base sheet contains printed information which may be confidential and a top sheet covers the base sheet. The top sheet includes repeated patterns of lines or shades of opaque material on paper for obscuring the printed information. It will be recognized that various patterns of lines of shades can be utilized with the present inventions and these patterns can be preprinted as described in connection with FIG. 7 or printed using a thermally reactive coating as described in connection with FIG. 9. The base sheet may be bond or like paper and the top sheet may be tissue or like paper.

The present invention enables the accomplishment of the objects and advantages mentioned above, and while a preferred embodiment and modifications of the invention have been disclosed herein, other variations thereof may occur to those skilled in the art. It is contemplated that all such variations and modifications not departing from the spirit and scope of the invention hereof are to be construed in accordance with the following claims.

What is claimed is:

1. A security system for a facsimile document, comprising:

a base sheet capable of having confidential information printed thereon for sending by a facsimile process; and a cover sheet laminated to said base sheet, said cover sheet having a plurality of sections with imprinted lines spaced from one another and forming an obscuring pattern in a repeated arrangement over the confidential information printed thereon and said imprinted lines being separated by portions of said cover sheet without imprinted lines also formed in a repeated arrangement.

2. The security system of claim 1 wherein said separating portions extend in cross-web manner on said cover sheet and occupy a lesser portion than the sections with imprinted lines.

3. The security system of claim 1 wherein said separating portions extend along the length of said cover sheet and occupy a lesser portion than the sections with imprinted lines.

4. The security system of claim 1 wherein said separating portions extend partially across said cover sheet and occupy a lesser portion than the sections with imprinted lines.

5. A method of obscuring confidential information printed on a document transmitted by a facsimile process, comprising the steps of:

providing a base sheet having such confidential information printed thereon; and covering said base sheet by laminating said base sheet with a cover sheet having a plurality of sections with imprinted lines thereon spaced from one another to form a pattern in a repeated arrangement for obscuring said confidential information, said sections being separated by portions of said cover sheet without imprinted lines also formed in a repeated arrangement.

6. The method of claim 5 including the step of coating the base sheet to enable adherence of the cover sheet to the base sheet.

7. The method of claim 6 including the step of drying the coating on the base sheet.

8. The method of claim 5 including the step of coating the cover sheet with a preactivated thermal coating.

9. The method of claim 8 including the step of drying the coating on the cover sheet prior to lamination thereof to the base sheet.

10. The method of claim 6 wherein the coating on the base sheet includes thermally reactive ingredients.

11. The method of claim 5 including the step of preprinting the cover sheet.

12. The method of claim 5 wherein the cover sheet is a preprinted tissue-type sheet.

13. The security system of claim 1 wherein said separating portions extend in diagonal manner on said cover sheet and occupy a lesser portion than the sections with imprinted lines.

14. The security system of claim 1 wherein said imprinted lines extend in diagonal manner on said cover sheet and said separating portions are perpendicular to the imprinted lines.

15. The security system of claim 4 wherein said separating portions are of generally rectangular shape and extend partially across said cover sheet.

16. The security system of claim 4 wherein said separating portions are spaced at different locations and extend partially across said cover sheet.

* * * * *